United States Patent [19]

Nakahira

[11] Patent Number: 4,460,111

[45] Date of Patent: Jul. 17, 1984

[54] APPARATUS FOR TURNING HOSE

[76] Inventor: Tomotake Nakahira, 140-5, Tsukiyama, Yamatotakadashi, Nara, Japan

[21] Appl. No.: 406,412

[22] Filed: Aug. 9, 1982

[51] Int. Cl.[3] ..... A41H 43/00

[52] U.S. Cl. ..... 223/43

[58] Field of Search ..... 223/39–43

[56] References Cited

U.S. PATENT DOCUMENTS

| | | | |
|---|---|---|---|
| 2,899,116 | 8/1959 | Long et al. | 223/43 |
| 2,931,544 | 4/1960 | De Spain | 223/43 |
| 3,908,874 | 9/1975 | Haselgrove et al. | 223/43 |
| 3,941,285 | 3/1976 | Bailey | 223/43 |
| 3,949,913 | 4/1976 | Smith et al. | 223/43 |

*Primary Examiner*—Louis Rimrodt

*Attorney, Agent, or Firm*—Eyre, Mann, Lucas & Just

[57] ABSTRACT

An apparatus for turning a circular knit hose inside out and sectioning same into unit hoses, includes an air suction pipe extending in the direction of feeding the knit hose, a pair of contact rollers carried on a carrier capable of reciprocally moving along the air suction pipe, the contact rollers frictionally retaining the knit hose covering the air suction pipe so as to allow the knit hose to be sucked into the pipe unit by unit with its tail end ahead. The apparatus includes a cutter for sectioning a protruded end portion of the knit hose from the air suction pipe.

3 Claims, 3 Drawing Figures

APPARATUS FOR TURNING HOSE

The present invention relates to an apparatus for turning a circular knit hose inside out and sectioning it into a required number of unit hoses. More particularly, the present invention relates to an apparatus for enabling a long continuous circular knit hose to be turned inside out and sectioned into unit hoses, thereby facilitating the subsequent linking and vapor setting processes.

In the production of hosiery, such as stockings and socks, a commonly-called "rib knitter" or a double cylinder knitting machine is employed to knit a long continuous circular hose. It is required that the hose be turned inside out and sectioned into unit hoses. The open end of each hose is closed by linking into the toe portion, and then each hose is vapor set in the state that its normal side is out. Conventionally, the circular knit hose is sectioned unit by unit by hand, wherein the stitches around the sectioned part are taken out by the operator' fingers. This is extremely labor-consuming, and more concretely, it does harm to the operators' eye. In addition, there is a danger of spoiling the hoses by taking out wrong stiches. In order to avoid such problems and troubles involved in the manual operation, several mechanical methods have been proposed, but they have found unsatisfactory partly because of the high cost and partly because of the spoiled finish touch of the general appearance.

The present invention aims at solving the difficulties mentioned above, and has for its object to provide an improved apparatus for turning a circular knit hose inside out and sectioning it into a required number of unit hoses in an automatic manner.

According to one aspect of the present invention, there is provided an apparatus of turning a circular knit hose inside out and sectioning it into unit hoses, comprising an air suction pipe extending in the direction of feeding the knit hose, a pair of contact rollers for exerting pressure on the hose covering the air suction pipe, the rollers being carried on a carrier capable of reciprocally moving along the air suction pipe, whereby the hose is dragged until it covers the air suction pipe from its tail end to its top end, the contact rollers frictionally retaining the knit hose so as to allow the knit hose to be sucked into the pipe unit by unit, and a cutter located adjacent to the top end of the air suction pipe, whereby a protruded end portion of the hose is sectioned into a unit hose.

The invention will be more particularly described by way of example with reference to the accompanying drawings, in which.

Figure 1:
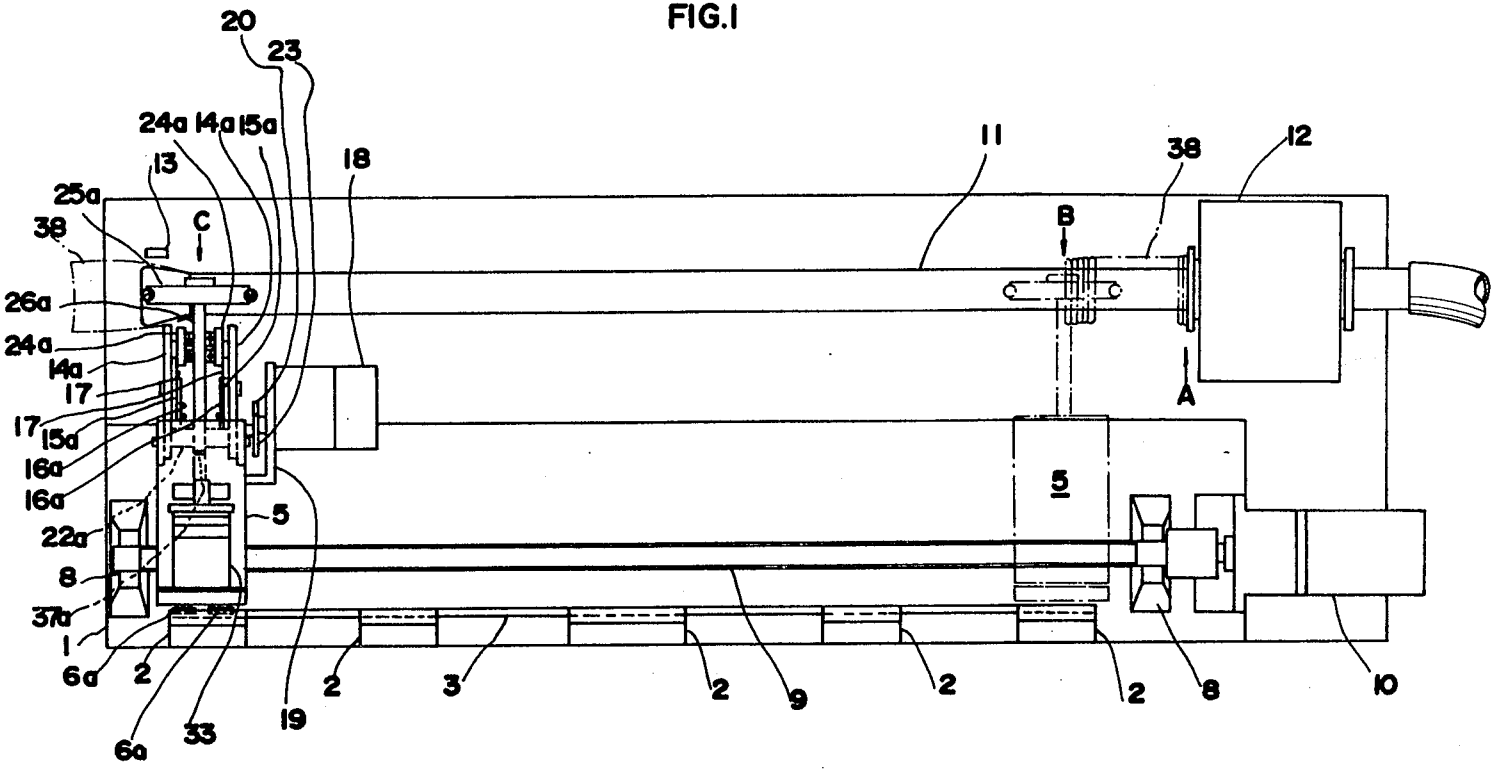
FIG. 1 is a plan view showing an apparatus according to the present invention for turning a circular knit hose inside out and sectioning it into unit hoses.
Figure 2:
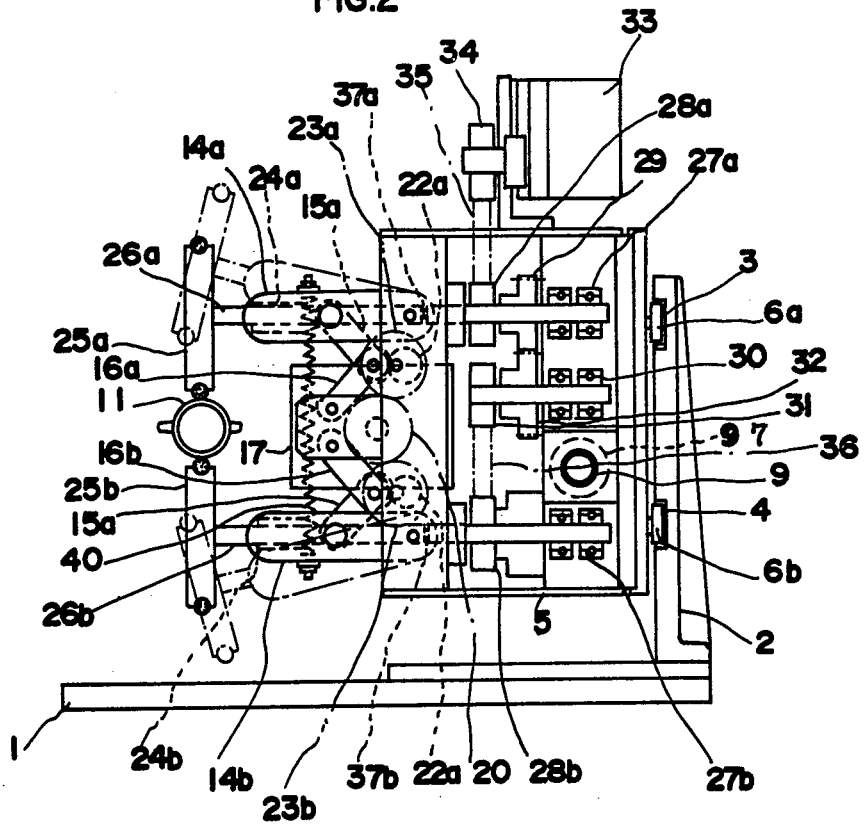
FIG. 2 is a side view of the apparatus of FIG. 1 taken from the lefthand side of FIG. 1.

Referring FIGS. 1 and 2, the apparatus includes a bed 1 which has several supports 2 erected with spaces at one edge thereof. A pair of guide rails 3, 4 are supported in parallel on the supports 2. Each guide rail 3, 4 has a channel-like cross-section. There is provided a carrier 5 adapted to move reciprocally along the guide rails 3, 4. The carrier 5 is provided with rollers 6*a*, 6*b* which are received in the channel-like guide rails 3, 4, respectively. The carrier 5 has a box-like structure on which a pair of contact rollers 25*a*, 25*b* are rotatively mounted. The other elements mounted on the carrier 5 are ancillary to the contact rollers 25*a*, 25*b*. The construction of the carrier 5 will be explained in greater detail as follows, through which like references designate like elements.

The carrier 5 is provided with an internally threaded sleeve 7 in its lower section. There is provided a feed screw 9 on the bed 1 in parallel with the guide rails 3, 4, the feed screw being supported through bearings 8 and connected to an electric motor 10. The electric motor 10 can be rotated in either direction, thereby enabling the feed screw 9 to rotate in either direction as desired. The feed screw 9 is passed through the internally threaded sleeve 7. In this way the carrier 5 is reciprocally moved along the feed screw 9, depending upon the rotating direction of the electric motor 10.

The carrier 5 is provided with two pairs of swinging arms 14*a* and 14*b*; the former pair being located in the upper section and the latter pair being located in the lower section.

Each pair of swinging arm 14*a*, 14*b* includes twined or paired elements for its associated members as shown in FIG. 1. For simplicity, reference will be made only to one element.

The swinging arm 14*a* is pivotally supported on a bracket 17 secured to the carrier 5 through links 15*a* and 16*a* which are pivotally connected to each other. Likewise, the lower swinging arm 14*b* is pivotally supported on the bracket 17 through links 15*b* and 16*b*, which are pivotally connected to each other. The swinging arms 14*a*, 14*b* are pivotally connected to the carrier 5 at their root portions. Each first link 15*a*, 15*b* is pivoted to the middle portion of each swinging arm 14*a*, 14*b*. There is provided a torque motor 18 mounted on the carrier 5 through a bracket 19, the torque motor 18 being intended to swing the swinging arms 14*a*, 14*b* through a cam mechanism, which will be explained in detail below:

The torque motor 18 is connected to a gear 20, which engages with gears 23*a*, 23*b*. The gear 23*a* is for the swinging arms 14*a*, and the gear 23*b* is for the swinging arms 14*b*. Each gear 23*a*, 23*b* is secured to a cam 22*a*, 22*b*, respectively, wherein the cams 22*a*, 22*b* are transversely provided in the carrier 5. Each cam 22*a*, 22*b* is located adjacent to each joint of the two links 15*a*, 16*a*, and 15*b*, 16*b* such that the cams 22*a*, 22*b* can work on the joint of these links so as to enable the links to open and close.

Each swinging arm 14*a*, 14*b* is provided with a bearing 24*a*, 24*b* through which a rotary shaft 26*a*, 26*b* is rotatively supported. The reference numeral 27*a*, 27*b* designate second bearings for supporting the rotary shafts 26*a*, 26*b* at the terminating ends. Each rotary shaft 26*a*, 26*b* supports the contact roller 25*a*, 25*b*. The rotary shaft 26*a* also supports a pulley 28*a*, and a gear 29. The rotary shaft 26*b* supports a pulley 28*b*. The pulley 28*a* is connected to a pulley 34 by means of a belt 35, wherein the pulley 34 is driven by an electric motor 33, commonly called "brake motor". There is provided a further pulley unit which consists of a rotary shaft 26*c*, a pulley 31, and a gear 32, wherein the pulley 31 and the gear 32 are secured to the rotary shaft 26*c*. A belt 36 is carried on the pulleys 31 and 28*b*. The reference numeral 30 designates bearings supporting the rotary shaft 26*c*. In this way, when the motor 33 is switched on, the drive is transmitted to the rotary shaft 26*a* through the belt 35, and to the rotary shaft 26*c* through the gears 29 and 32, and finally to the rotary shaft 26*b* through the belt 36. The rotary shafts 26*a*, 26*b* are provided with universal joints 37*a*, 37*b*, respectively, whereby the rotary shafts can angularly swing as shown in FIG. 2.

There is provided an air suction pipe 11 in parallel with the feed screw 9, the air suction pipe 11 being adapted to allow a knit hose to be sucked therethrough during which the hose is turned inside out. The air suction pipe 11 is connected to a vacuum pump (not shown). The reference numeral 12 designates a fixture for securing the air suction pipe 11 to the bed 1. In this specification the lefthand end of the pipe 11 will be referred to as "tail end" whereas the righthand end will be as "top end". A phototube 13 is provided adjacent to the tail end of the pipe 11, the phototube 13 being electrically connected to the torque motor 18 so as to move the swinging arms 14*a*, 14*b*. It senses the initial placement of the knit hose 38 around the tail end of the air suction pipe 11.

Figure 3:
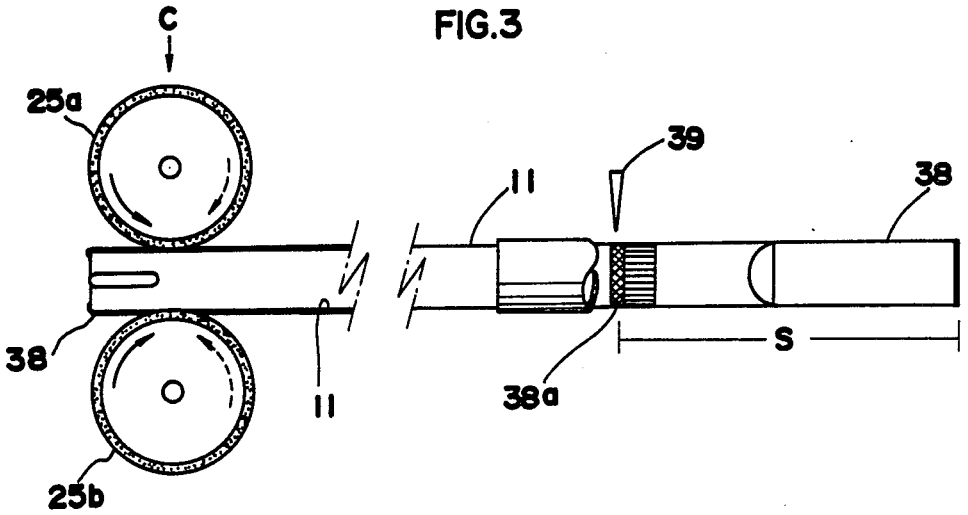
FIG. 3 is a view, on an enlarged scale, showing the cutting section where a hose extracted by unit length under air suction is sectioned by a cutter.

Referring to FIG. 3 the reference numeral 39 designates a cutter located adjacent to the top end of the air suction pipe 11, the cutter 39 being adapted to cut along a predetermined outline 38*a* specially knitted for the cutting purpose.

In FIG. 1 the reference numeral 40 designates a coil spring whereby the swinging arms 14*a* and 14*b* are urged toward each other.

Now, reference will be made to a typical example of operation:

A long continuous circular knit hose 38 is fed from the "rib knitter" (not shown) to the apparatus. As shown in FIG. 1, the top end of the knit hose 38 is placed around the tail end of the air suction pipe 11. The initial placement of the knit hose 38 is sensed by the phototube 13, thereby switching on the motor 18. Thus the swinging arms 14*a*, 14*b* are caused to approach to the knit hose 38 surrounding the air suction pipe 11 through the operation of the cams 22*a*, 22*b*. Normally the links 15*a*, 16*a* and 15*b*, 16*b* are kept open against the coil spring 40, thereby keeping the contact rollers 25*a*, 25*b* away from the air suction pipe 11. But when the motor 18 is energized, the links 15*a*, 16*a* and 15*b*, 16*b* are released from the stop provided by the cams 22*a*, 22*b*, the swinging arms 14*a*, 14*b* are drawn to each other under the tension of the coil spring 40. In this way the rollers 25*a*, 25*b* are placed into contact with the knit hose 38, and at this stage the motor 33 is switched on, thereby causing the rollers 25*a*, 25*b* to rotate as they keep contact with the knit hose 38. The rollers 25*a*, 25*b* are rotated in the direction in which the knit hose 38 is forcibly fed toward the top end of the air suction pipe 11, as shown in FIG. 3. When the rollers 25*a*, 25*b* are rotated, the motor 10 is switched on to move the carrier 5. In this way the knit hose 38 is caused to slide on the surface of the air suction pipe 11 toward the top end thereof. The initial end of the knit hose 38 reaches at a position (A). When the carrier 5 reaches at a position (B), the motors 10 and 33 are switched off. It is previously calculated that when the carrier 5 reaches at the position (B) the tail end of the knit hose 38 comes slightly outside the tail end of the air suction pipe 11; otherwise it would be impossible for the knit hose to be sucked into the air suction pipe 11. The calculation is made by taking into account the rotating speed of the rollers 25*a*, 25*b*, the speed of the carrier 5 and the total length of the knit hose 38, and based upon the calculation a timer is set.

When the carrier 5 reaches at the position (B), the vacuum pump (not shown) is switched on. At the same time, the motor 33 is switched off to stop the rotation of the contact rollers 25*a*, 25*b*, but they keep contact with the knit hose 38. At this stage, the motor 10 is reversely rotated, thereby causing the carrier 5 to return to the original position (C). In the course of the return travel the contact rollers 25*a*, 25*b* urge the knit hose 38 by friction toward the tail end of the air suction pipe 11, which helps the knit hose 38 to be sucked into the air suction pipe 11. When the contact rollers 25*a*, 25*b* reach at the position (C), they are again but reversely rotated, thereby causing the knit hose 38 turned inside out in the pipe 11 to advance until its tail end protrudes by a desired unit length from the top end of the pipe 11. In FIG. 3 the desired unit length is indicated by (S). Finally the knit hose 38 is sectioned along the predetermined outline 38*a* by the cutter 39, which is prearranged so as to work on each unit hose successively protruded through the top end of the pipe 11. It is necessary for the rollers 25*a*, 25*b* to keep contact with the knit hose 38 which is being sucked into the pipe 11, otherwise, the knit hose would be wholly sucked into the pipe 11.

As is evident from the foregoing, it is essential for the contact rollers 25*a*, 25*b* to impart friction drive to the knit hose 38 extended to cover the air suction pipe 11. To this end, it is preferred that the contact rollers 25*a*, 25*b* are provided with frictional bands on their rims. The frictional bands include rubber bands or cloth bands or any other frictional plastic bands.

What is claimed is:

1. An apparatus for turning a circular knit hose inside out and sectioning same into unit hoses:

a bed;

an air suction pipe for pulling a circular knit hose by suction therethrough, said air suction pipe extending along the length of said bed;

a carrier reciprocally moving along said air suction pipe;

a pair of contact rollers carried on said carrier, said contact rollers being located in opposite sides to said air suction pipe;

a swinging means for enabling said contact rollers to move toward and from said air suction pipe, said swinging means being carried on said carrier; said contact rollers being capable of rotating in either direction; and a cutter located adjacent to the top end of said air suction pipe.

2. An apparatus as defined in claim 1, wherein said swinging means comprises a pair of swinging arms secured to said contact rollers, said swinging arms being pivotally supported to said carrier by means of pivotal links whereby said swinging action of said contact rollers is effected.

3. An apparatus as defined in claims 1 or 2, wherein said contact rollers are provided with frictional bands on their rims, thereby increasing the friction drive imparted by said contact rollers to said knit hose.

* * * * *